US010299585B2

(12) United States Patent
Mason et al.

(10) Patent No.: US 10,299,585 B2
(45) Date of Patent: May 28, 2019

(54) FRAME FOR A MOVABLE FURNITURE PART

(71) Applicant: GRASS AMERICA, INC., Kernersville, NC (US)

(72) Inventors: Dale William Mason, Ashburn, VA (US); Christopher Blane Bowman, Mount Airy, NC (US); Manfred Peer, Walkertown, NC (US); Judd Whyatt, Greensboro, NC (US)

(73) Assignee: Grass America, Inc., Kernersville, NC (US)

( * ) Notice: Subject to any disclaimer, the term of this patent is extended or adjusted under 35 U.S.C. 154(b) by 0 days.

(21) Appl. No.: 15/215,920

(22) Filed: Jul. 21, 2016

(65) Prior Publication Data

US 2018/0020832 A1 Jan. 25, 2018

(51) Int. Cl.

| | |
|---|---|
| ***A47B 88/40*** | (2017.01) |
| ***A47B 88/493*** | (2017.01) |
| ***A47B 88/57*** | (2017.01) |
| *A47B 88/42* | (2017.01) |

(52) U.S. Cl.

CPC ..... *A47B 88/40* (2017.01); *A47B 88/493* (2017.01); *A47B 88/57* (2017.01); *A47B 2088/422* (2017.01)

(58) Field of Classification Search

CPC ..... A47B 88/437; A47B 2210/0059; A47B 88/493; A47B 2210/0032; A47B 88/43; A47B 2210/0035; A47B 88/90; A47B 88/941; A47B 88/956; A47B 2210/02; A47B 88/427; A47B 2088/902; A47B 88/40; A47B 2088/952; A47B 2088/953; A47B 88/49; A47B 2210/095; A47B 88/95; A47B 88/57; A47B 2088/422

USPC ..... 348/18–20; 312/348.3, 263, 265.5, 312/334.5, 334.4, 330.1, 334.1, 334.7, 312/334.8, 334.9, 334.11, 334.12, 334.17, 312/334.19, 334.21, 334.22, 348.6, 348.1, 312/348.2, 348.4

See application file for complete search history.

(56) References Cited

U.S. PATENT DOCUMENTS

| | | | | | |
|---|---|---|---|---|---|
| 3,912,341 | A * | 10/1975 | Stein | A47B 88/493 | 312/331 |
| 4,138,176 | A * | 2/1979 | Cowdroy | A47B 88/483 | 312/334.16 |
| 4,285,560 | A * | 8/1981 | Miller | A47B 88/493 | 108/83 |
| 4,331,369 | A * | 5/1982 | Lazar | A47B 88/427 | 312/334.8 |
| 4,438,994 | A * | 3/1984 | Davis | A47B 88/487 | 312/334.18 |
| 4,601,522 | A * | 7/1986 | Rock | A47B 88/487 | 312/332 |
| 4,621,876 | A * | 11/1986 | Reimer | A47B 88/487 | 16/100 |

(Continued)

*Primary Examiner* — Hiwot E Tefera
(74) *Attorney, Agent, or Firm* — Burr & Brown, PLLC

(57) ABSTRACT

Frame for a movable furniture part, in particular for a drawer, wherein the frame is single-walled and a single-walled frame element forms a side wall of the movable furniture part, wherein a guide element of an extension mechanism for the movable furniture part is arranged on the frame element by fastening means. The frame is characterized in that the fastening means engage through the frame element.

15 Claims, 10 Drawing Sheets

(56) References Cited

U.S. PATENT DOCUMENTS

| | | | | | |
|---|---|---|---|---|---|
| 4,660,905 | A * | 4/1987 | Conner | A47B 17/00 | 248/525 |
| 4,802,716 | A * | 2/1989 | Rock | A47B 88/941 | 312/263 |
| 4,902,080 | A * | 2/1990 | Berger | A47B 88/00 | 312/348.1 |
| 4,929,097 | A * | 5/1990 | Mottate | F16C 29/04 | 312/331 |
| 5,385,405 | A * | 1/1995 | Hobbs | A47B 88/437 | 384/19 |
| 5,542,759 | A * | 8/1996 | Krivec | A47B 88/493 | 312/333 |
| 5,823,650 | A * | 10/1998 | Lin | A47B 88/956 | 312/265.5 |
| 5,895,101 | A * | 4/1999 | Cabrales | A47B 88/493 | 312/334.11 |
| 6,010,200 | A * | 1/2000 | Hays | A47B 88/427 | 312/334.12 |
| 6,155,662 | A * | 12/2000 | Fookes | A47B 47/00 | 248/678 |
| 6,478,393 | B2 * | 11/2002 | Kim | A47B 88/493 | 312/330.1 |
| 6,988,626 | B2 * | 1/2006 | Varghese | G06F 1/16 | 211/131.1 |
| 8,585,165 | B2 * | 11/2013 | Liang | A47B 88/427 | 312/334.4 |
| 2009/0174299 | A1 * | 7/2009 | Lam | A47B 88/956 | 312/348.4 |
| 2012/0176015 | A1 * | 7/2012 | Liang | A47B 88/427 | 312/334.4 |

* cited by examiner

FRAME FOR A MOVABLE FURNITURE PART

FIELD OF THE INVENTION

The present invention relates to a frame for a movable furniture part, to a movable furniture part having such a frame, and to an item of furniture having such a movable furniture part and/or such a frame.

BACKGROUND OF THE INVENTION

A frame of the type described at the outset is known, for example, in the form of a frame which forms a side wall of a drawer. A drawer guide rail of a drawer extension mechanism is able to be screwed to such a frame, for example, to an outer side of the frame.

A disadvantage of this is that a length of a screw for attaching the drawer guide rail to the frame has to be adapted to a width of the frame such that, in the arranged state, the screw does not protrude beyond an inner surface of the frame, which faces an interior of the drawer, since otherwise there is for example a risk of injury to a user of the drawer.

SUMMARY OF THE INVENTION

The present invention is based on the object of providing an alternative frame for a movable furniture part.

The present invention relates to a frame for a movable furniture part, in particular, for a drawer, wherein the frame comprises a single-walled frame element which forms a side wall of the movable furniture part, wherein a guide element of an extension mechanism for the movable furniture part is arranged on the frame element by fastening means.

The extension mechanism is configured, for example, as a partial- or full-extension mechanism. Thus, guide elements of the extension mechanism are configured, for example, as a carcass rail, a central rail and a frame rail or a drawer rail. In this case, in the arranged state of the extension mechanism on the item of furniture, the frame rail or drawer rail is present on a frame of the drawer, wherein, in particular, the frame forms a side wall of the movable furniture part.

For example, the frame element, in particular the frame, forms an inner lateral surface of an interior of the drawer. It is also conceivable for a panel element to be arranged on the inner lateral surface of the frame element. A lateral surface of the panel element can thus form the inner lateral surface of the interior of the movable furniture part.

The frame, in particular the frame element, is for example configured to arrange a base element, a rear-wall element and/or a front element of the movable furniture part thereon.

A single-walled frame, or a single-walled frame element, should be understood as meaning, in particular, an element which does not have a cavity. A single-walled frame element can be configured, for example, as a simple sheet-metal element. However, it is also conceivable for two or more sheet-metal elements to be present in a manner stacked one on another and optionally joined together, wherein the sheet-metal elements bear against one another in a flush and leaktight manner and no cavity is present between the sheet-metal elements. It is furthermore conceivable for a single-walled frame element to be formed, for example, such that two sheet-metal elements are arranged alongside one another and a filling material, for example an insulation material, which fills a space between the sheet-metal elements in particular completely, is present between the sheet-metal elements.

The essential aspect of the present invention can thus be considered to be that the fastening means engage through the frame element. As a result, a guide element is arranged in a comparatively simple, secure and/or firm manner by way of the fastening means.

Preferably, the guide element is arranged on the side wall of the frame via at least two, in particular, three, four, five or more fastening means.

Furthermore, it is advantageous for the guide element to be joined to the frame.

If the guide element is joined to the frame, it is advantageously present in a fixed position on the frame. Advantageously, the guide element is connected to the side wall in a non-detachable manner by the fastening means. The guide element is for example riveted, clinched, welded, adhesively bonded and/or screwed to the side wall. For example, the frame element or the frame is connected to the guide element by means of a clinch-joining method. In particular, this creates a connection between the frame and guide element which allows a comparatively large loading capacity and a comparatively high weight of the drawer.

Furthermore, it has proved to be advantageous for the extension mechanism to comprise a ball guide.

The guide elements of the extension mechanism are advantageously supported on one another so as to be movable with respect to one another via a guide, for example a ball bearing, in particular, a ball guide. It is also conceivable for the guide elements to be supported in a movable manner on one another by means of a rolling bearing. The ball bearings or rolling bearings are in this case preferably held together in the guide, for example in a cage, for example, what is known as a roller carriage. It is furthermore conceivable for the extension mechanism to comprise a plurality of guides, for example two roller carriages.

It has also proved to be advantageous for the fastening means to comprise a rivet.

As a result, the guide element can either already be arranged on the frame element and/or the frame in a production step or can be arranged thereon on-site when the movable furniture part is mounted on the item of furniture. Thus, the frame and the extension mechanism can advantageously be produced at separate locations and transported therefrom and connected together only for example when the movable furniture part is mounted on the item of furniture.

The fastening means can also comprise a screw, adhesive and/or welding means. A fastening means can also be configured as a clamping and/or latching element, for example as a hook.

Moreover, it is advantageous for the frame element to have a depression and for the depression to be present in a recessed manner on the inner lateral surface of the frame element. As a result, the frame element is advantageously formed in a reinforced manner.

The depression is pressed, for example, into the frame element, for example, bent, stamped and/or shaped out of the frame element. If the frame element is made of wood, the term molding is used instead of depression. The depression or molding preferably forms a hollow, bend, recess and/or indentation on the inner lateral surface of the frame element.

The depression advantageously comprises a through-hole or a through-opening for arranging the fastening means. For example, the fastening means engage through the depression and/or the frame and/or the frame element at the through-hole or at the through-opening.

It has also proved to be advantageous for the fastening means to be arranged at the depression such that the fastening means do not protrude beyond the remaining inner lateral surface, remaining in particular with regard to the depression, of the frame element.

For example, the fastening means engage through the frame element at the depression such that the fastening means are present on the inner lateral surface of the frame element in a recessed manner with respect to the remaining inner lateral surface at the depression. For example, the fastening means comprise a head member, for example a screw head of a screw or a rivet head of a rivet, which is present in a flush or recessed manner with respect to the inner lateral surface at the depression. For example, one surface of the screw head, in which in particular an assembly pattern, for example a slot for a screwdriver, is present, is flush with the inner lateral surface of the frame element.

Furthermore, it is advantageous for the fastening means to be present on the guide element, on a side formed opposite the inner side of the frame element, in such a manner that the fastening means allow a movement of the guide elements of the extension mechanism, in particular a movement of the guide, for example the ball guide, of the extension mechanism, in the arranged state of the frame on the extension mechanism. This produces a large range of movement of the extension mechanism.

Preferably, the fastening means engage through the guide element in the arranged state of the guide element on the frame. For example, the fastening means are present in a manner flush with a surface of the guide element in the arranged state of the guide element on the frame. If the guide element is for example adhesively bonded, welded and/or clamped to the frame, it is conceivable for the fastening means not to engage through the guide element.

A further advantageous configuration of the frame is that the guide element arranged immediately, for example, directly on the frame and/or on the frame element is present in a U-shaped manner.

The guide element is advantageously configured as a, for example, turned up guide rail and is configured in a U-shaped manner in cross section perpendicularly to a longitudinal axis. A turned up side, in particular, two turned up sides, of the guide element is shaped, for example configured in a curved, undulating or dented manner, for example, such that it forms a guide groove or guide channel for guiding a bearing of the extension mechanism. A turned up side of the guide element corresponds for example to a short side of the U. By way of the connecting side of the U-shaped guide element, the guide element is arranged for example directly on the frame or the frame element. The guide element is in touching contact with the frame element for example in the arranged state of the frame element. Advantageously, the turned up short side is present on the guide element or the connecting side in particular in a manner protruding perpendicularly from the frame element.

It is furthermore proposed that the depression and/or the fastening means are covered by a covering means. As a result, an interior of the movable furniture part is able to be configured advantageously in an esthetic manner.

Preferably, the depression is and/or the fastening means are configured to arrange the covering means.

The covering means are configured for example as a covering cap and, in the arranged state, conceal the fastening means and/or the depression for an observer. Advantageously, a surface of the covering cap is present flush with the inner lateral surface of the frame element in the arranged state on the side wall.

It is also conceivable for the covering means to comprise a panel element which is able to be arranged on the inner lateral surface of the frame element and forms an inner lateral surface of the interior of the drawer for example in the arranged state of the panel element.

The depression comprises for example a bulge at which the covering means can engage. It is also conceivable for the depression to be configured in particular in a conically tapering manner towards the inner lateral surface of the frame element. For example, the covering means are configured to be clampable and or latchable at the depression, for example the bulge of the depression. It is furthermore conceivable for the depression, in particular the frame element in the region of the depression, to comprise an opening for arranging the covering means. For example, the opening in the frame element is cut out and/or punched out. The covering means advantageously engage through and/or around the opening for arranging the covering means.

Moreover, it is preferred for the depression to have a base that is recessed with respect to the inner lateral surface of the frame element, the guide element being fastened to said base.

Advantageously, the guide element is fastened to the frame element in the region of the depression. The depression is configured for example such that the guide element is present at a distance from a remaining outer surface of the frame element with respect to the depression. The outer surface of the frame element is advantageously present on the frame element opposite the inner lateral surface.

Preferably, the guide element is arranged immediately and directly at the depression, in particular, at the base of the depression. Immediately and directly should advantageously be understood as meaning that the guide element and the base of the depression are arranged so as to rest against one another, in contact with one another, being separated from one another only possibly by a fastening means, for example, an adhesive or adhesive layer or a welding means, for example a weld.

It is also preferable for the frame, in particular the frame element, to be present in one piece. As a result, the frame is relatively cost-effective and easy to produce.

The frame or the frame element is advantageously shaped or bent out of one element, for example, a sheet-metal element. The depression can be introduced into the frame or the frame element advantageously directly or immediately, during the process for forming the frame for example from the sheet-metal element.

It is advantageous for the frame, in particular, the frame element and/or the guide element to be formed from metal and/or plastics material.

For example, the frame and/or the guide element is shaped out of a metal sheet.

It is also advantageous for the frame to have a front and/or rear-wall attachment for arranging a front element and/or a rear-wall element of the movable furniture part, wherein, in order to connect the front and/or rear-wall attachment to the front element, for example a drawer front, and/or the rear-wall element, for example a drawer rear wall, of the movable furniture part, a plug and/or a screw and/or a similar fastening device is provided.

It has also proved to be advantageous for the frame to have a height adjustment and/or lateral adjustment means on the front and/or rear-wall attachment, in order to be able to position the front element and/or the rear-wall element of the movable furniture part at a height and/or in a lateral orientation with respect to the frame in the state arranged on the frame. This produces height or lateral adjustment of the drawer front in the arranged state on the item of furniture. As a result, for example, a clearance of the item of furniture is settable.

BRIEF DESCRIPTION OF THE DRAWINGS

A plurality of exemplary embodiments are explained in more detail with reference to the following, schematic drawings, indicating further details and advantages.

DETAILED DESCRIPTION OF THE INVENTION

Figure 1:
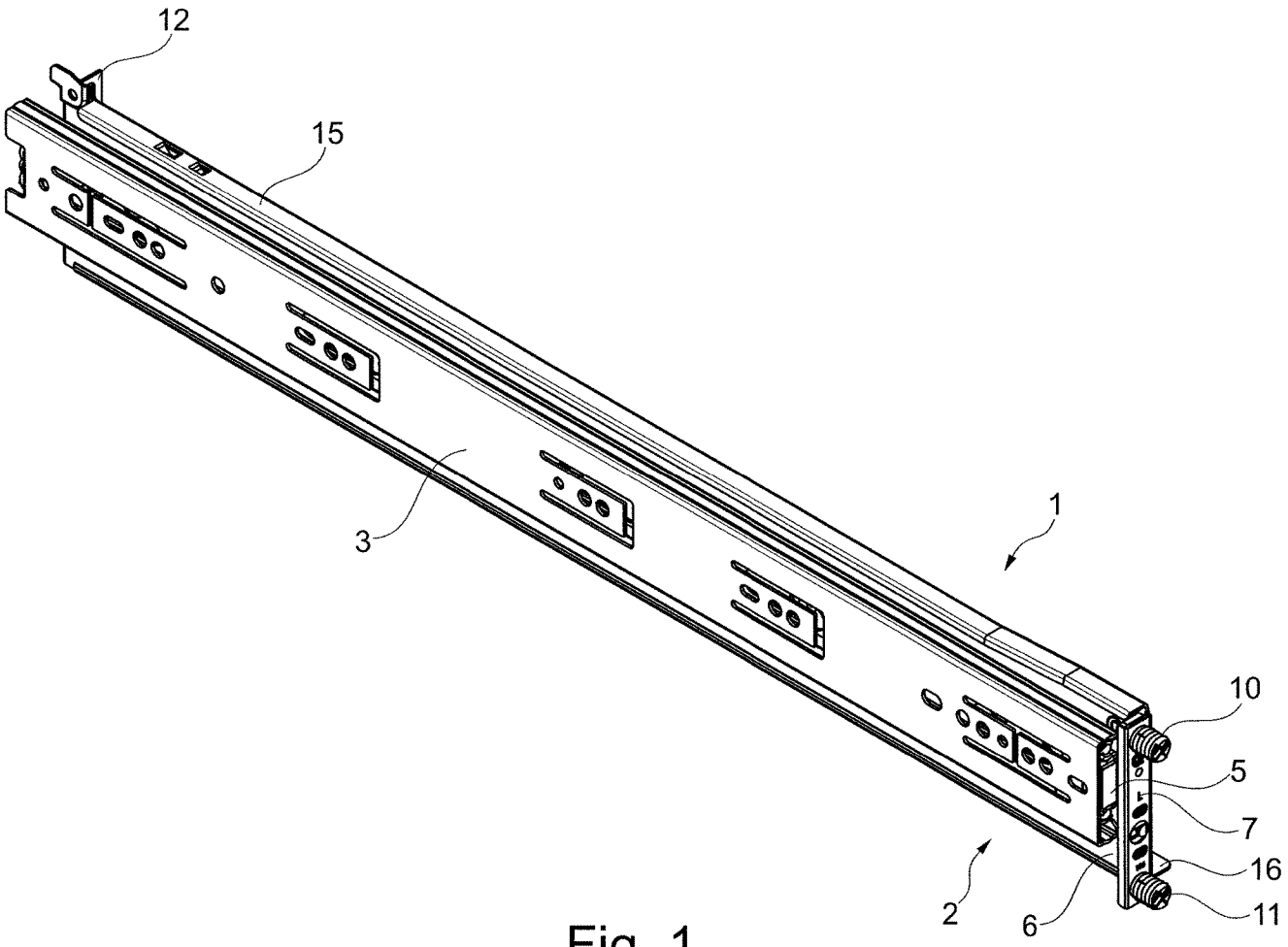
FIG. 1 shows an external front lateral oblique perspective view of a frame according to the present invention having an arranged extension mechanism.

A frame 1 according to the present invention is shaped or turned up for example out of a sheet-metal element (FIG. 1). Arranged on the frame 1 is an extension mechanism 2 in the form of a full-extension mechanism, consisting for example of a carcass rail 3, a central rail 4 and a drawer rail 5.

Figure 9:
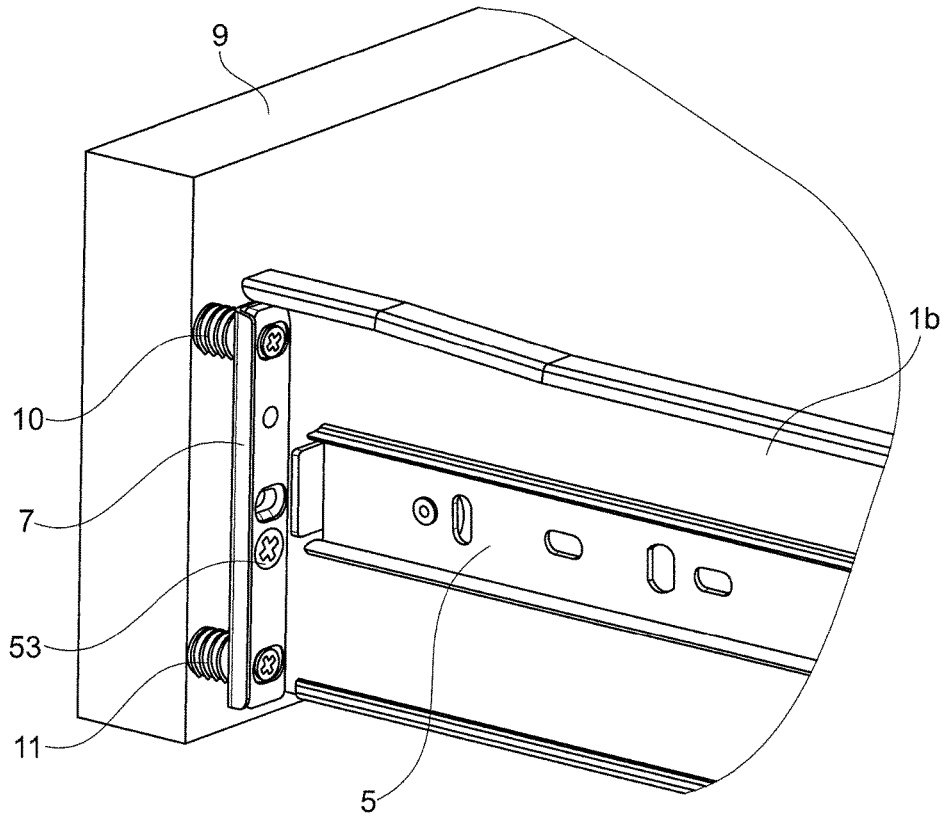
FIGS. 9 and 10 show a top rear lateral oblique perspective view of a front-side detail of the drawer from FIG. 7, having front attachment variants.
Figure 10:
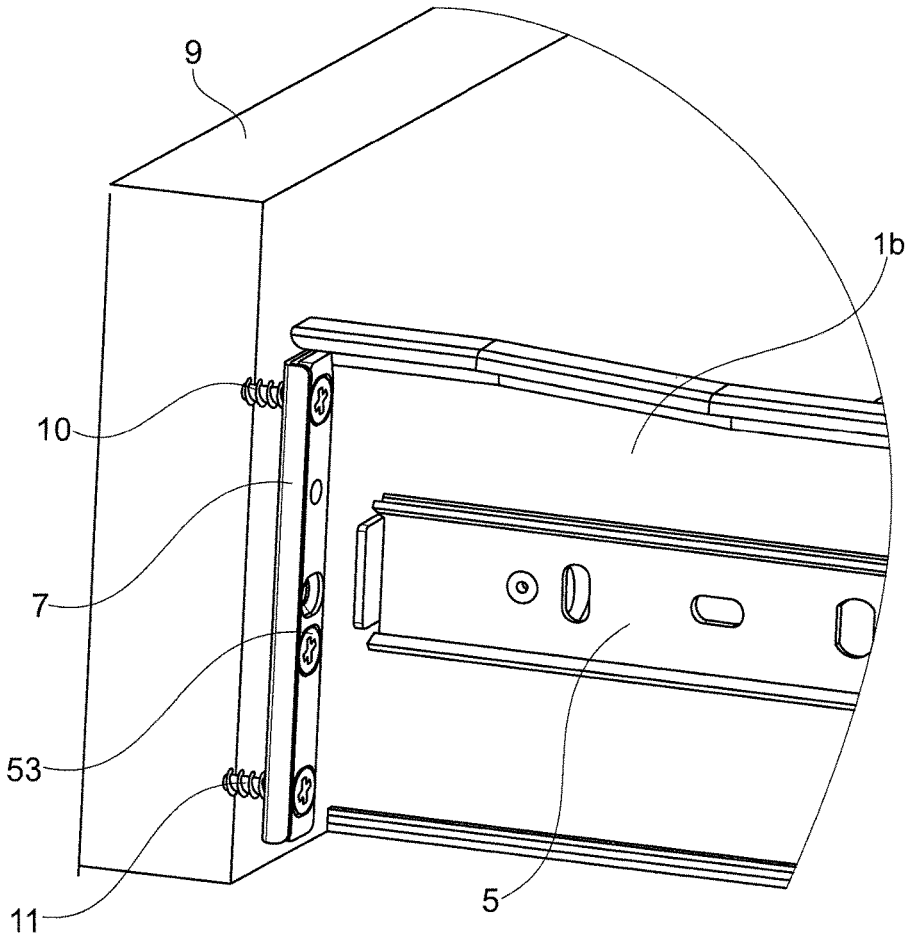

The frame 1 comprises a frame element in the form of a side wall 6, on which a bent-over portion 7 is present at a first end, i.e. a front end, the bent-over portion 7 serving as an abutment against a drawer front 9 in the state arranged on a drawer 8. In order to attach the drawer front 9 to the frame 1, pegs 10, 11 in the form of plugs or screws are present on the bent-over portion 7 (FIGS. 9 and 10). At a second end, present opposite the first end, of the frame, i.e. a rear end, a further bent-over portion 12 is present, which serves as an abutment against a drawer rear wall 13 in the state arranged on the drawer 8. In order to attach the drawer rear wall 13 to the frame 1, a further peg 14 in the form of a plug or a screw is present on the bent-over portion 12.

Both the bent-over portion 7 and the bent-over portion 12 are present for example in a manner protruding from the side wall 6, wherein the bent-over portions advantageously protrude from the side wall 6 perpendicularly with respect to a longitudinal extent of the side wall 6. For example, the bent-over portion 7 is present on the side wall 6 in a manner protruding perpendicularly outward and the bent-over portion 12 is present on the side wall 6 in an opposite manner protruding perpendicularly inward.

Along the longitudinal axis of the side wall 6, the frame 1 comprises an upper fold 15, for example, in the form of a lip, which forms an upper lateral surface of a side wall of the drawer 8 in the arranged state of the frame 1 on the drawer 8. The upper fold 15 is present on the side wall 6, for example, in a manner protruding perpendicularly outward. For example protruding such that the upper fold 15, in the arranged state of the frame 1 on an item of furniture, conceals a guide element of the extension element 2, in particular, the drawer rail 5 and/or the central rail 4, in particular, in the extended state of the drawer 8 on the item of furniture, from a plan view of the upper fold 15 or of the frame 1.

Figure 11:
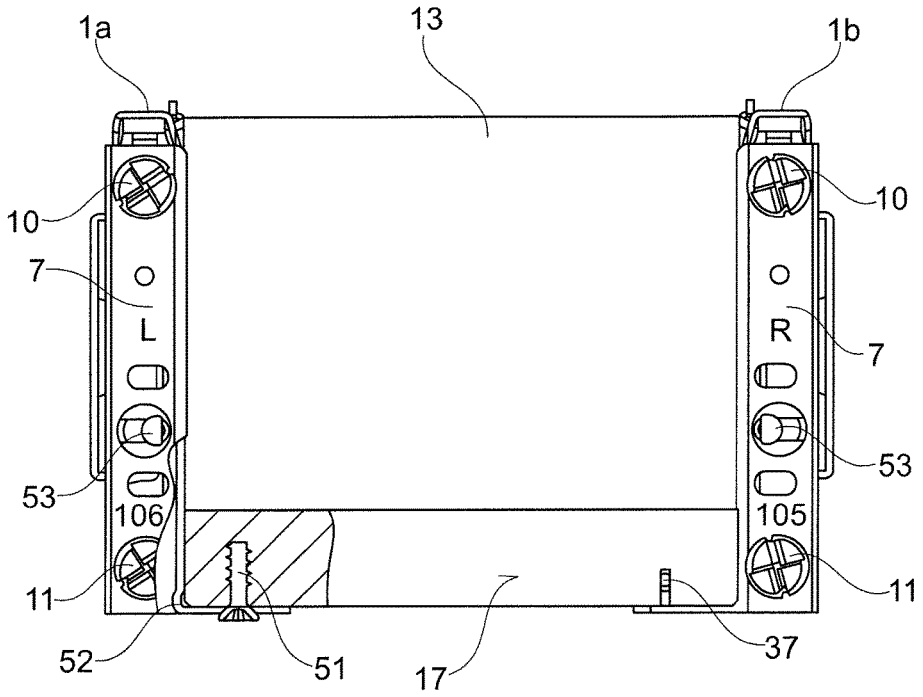
FIG. 11 shows a front view of the drawer from FIG. 7, without arranged drawer front with a base cutaway.

Furthermore, the side wall 6 has, along its longitudinal axis, a lower fold 16, for example, in the form of a lip, which is configured for the arrangement of a drawer base 17 of the drawer 8. The lower fold 16 is present on the side wall 6 for example in a manner protruding perpendicularly inward. Retaining elements 35-37 are formed on the lower fold 16 as upwardly bent lugs which are intended to retain the drawer base 17 in the arranged state. It is furthermore conceivable for screws 51 to be provided in order to connect the drawer base 17 to the frame 1, 1*a*, 1*b*, in particular, in a fixed position and advantageously in a non-detachable manner, for example, at the fold 16 (FIG. 11). The fold 16 can furthermore comprise a cutout 52, in particular, in the attachment region, the bent region with respect to the frame element of the frame 1. This avoids a rounding or bevel, for example a chamfer, in the bent region, thereby creating space for attaching the drawer base 17 such that the drawer base 17 is connectable to the frame 1 in an abutting manner, in particular without a gap.

Figure 2:
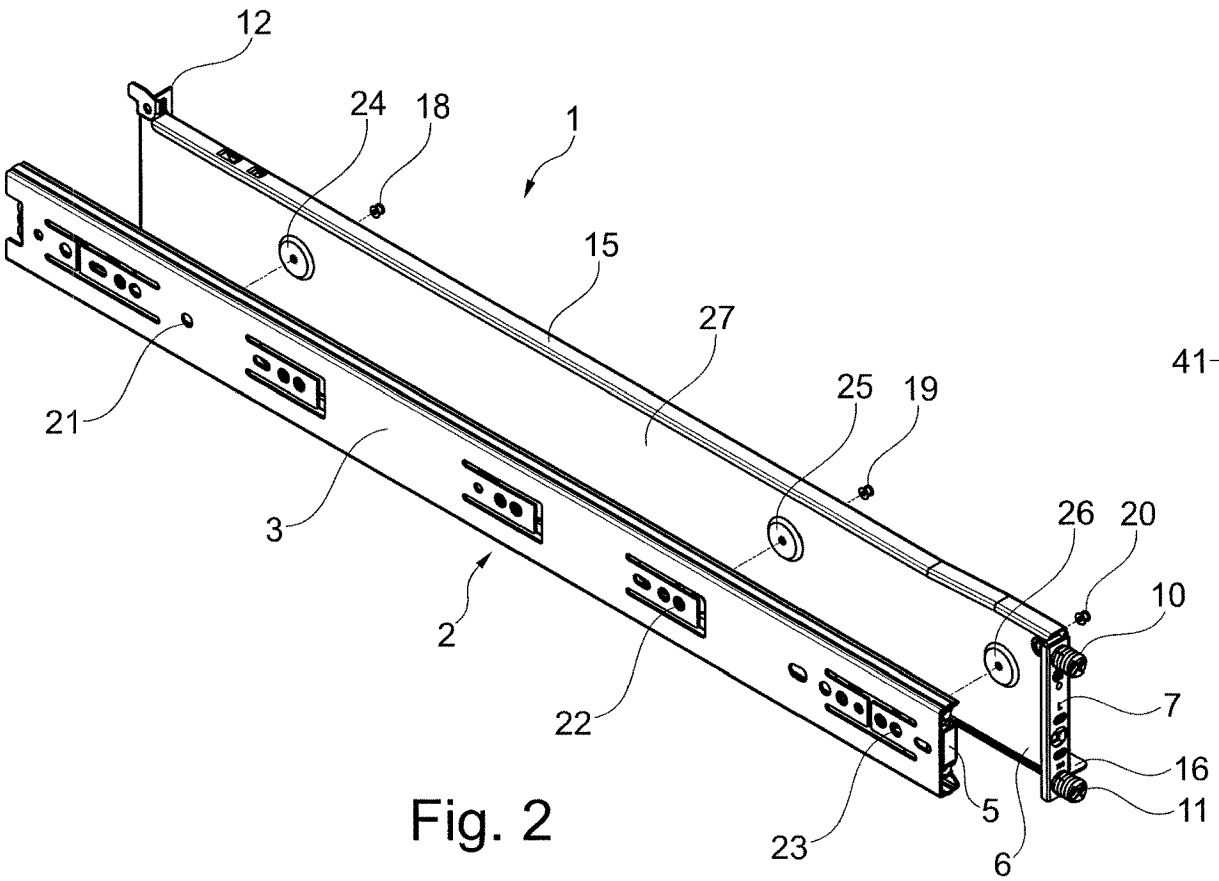
FIG. 2 shows an exploded illustration of an external front lateral oblique perspective view of the frame from FIG. 1 having an arranged extension mechanism.

The extension mechanism 2 is joined to the frame 1 via the drawer rail 5 for example by means of rivets 18-20. To this end, the extension mechanism 2 comprises assembly openings 21-23 in which for example a riveting tool can engage in order to attach, for example rivet, the already assembled extension mechanism 2, consisting inter alia of the carcass rail 3, the central rail 4 and the drawer rail 5, to the frame 1 by way of the drawer rail 5 (FIG. 2).

In order to attach the extension mechanism 2, indentations 24-26 in the form of depressions are present on the side wall 6 of the frame 1. The depressions 24-26 are shaped such that they protrude from an outer side 27 of the side wall 6. The outer side 27 advantageously forms an outer side of the drawer 8 in the state arranged on the drawer 8.

Also present at the depressions are assembly openings 28-30 through which fastening means, for example the rivets 18-20, can be guided. It is conceivable for the assembly openings 28-30 to have for example internal threads. As a result, it is conceivable for the drawer rail 5 of the extension mechanism 2 to be fastenable to the frame 1 by means of screw elements.

Figure 3:
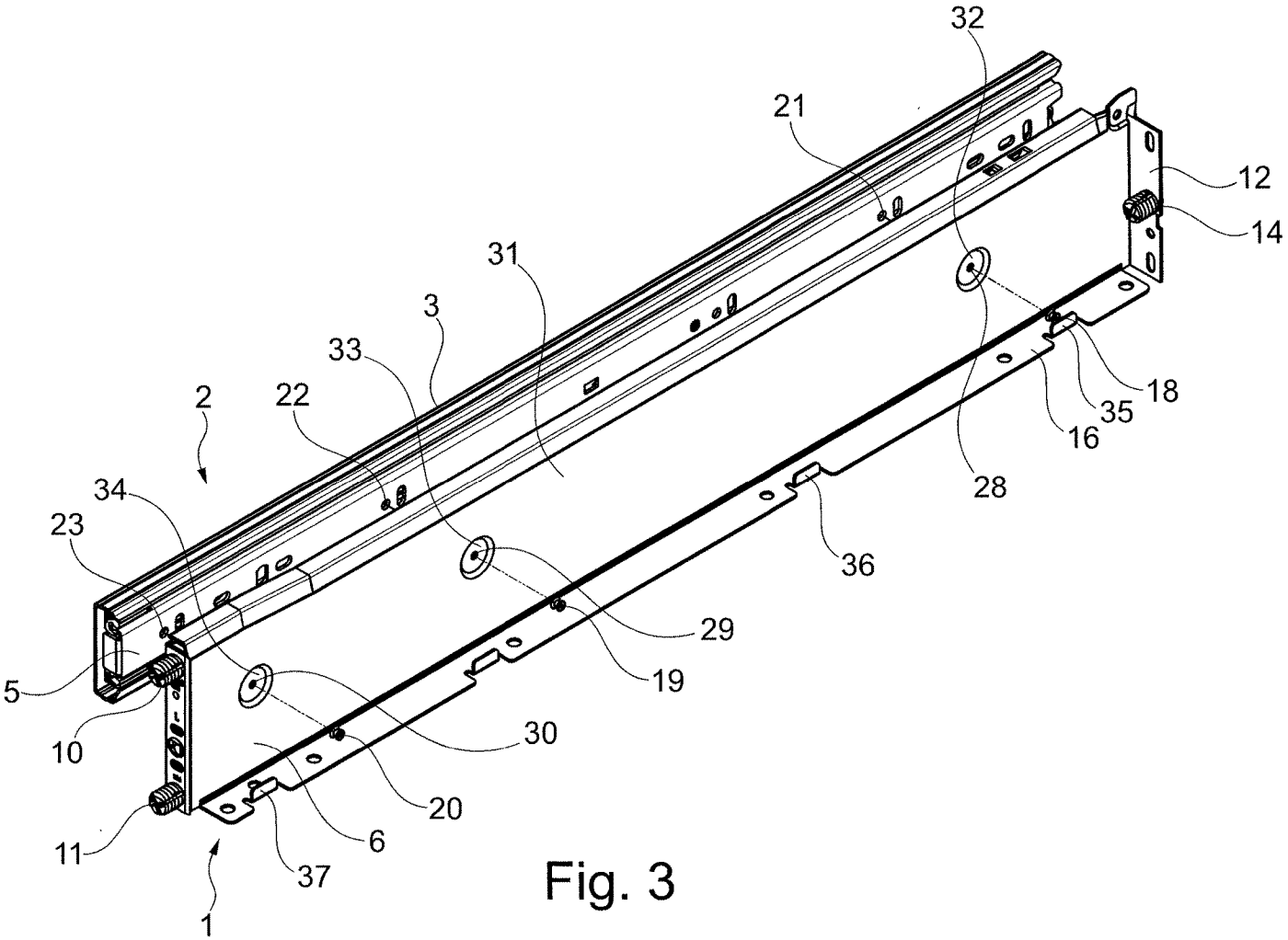
FIG. 3 shows an internal front lateral oblique perspective view of the exploded illustration from FIG. 2.

The depressions 24-26 are present on the side wall 6 in a manner set back from an inner side 31 of the side wall 6 of the frame 1. The inner side 31 forms for example an inner lateral surface of the drawer 8 in the assembled state. For example, the depressions 24-26 comprise a base element 32-34 which is present in a recessed manner with respect to the inner side 31 (FIG. 3).

Figure 4:
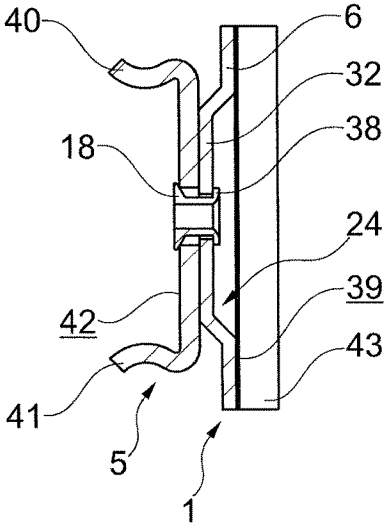
FIG. 4 shows a view of a detail of a cross section perpendicular to a longitudinal axis of the frame from FIG. 1, having an arranged guide element of the extension mechanism and an arranged decoration.

FIG. 4 shows that a rivet head 38 of the rivet 18 is present in a manner set back with respect to the remaining surface 39 of the inner side 31 of the side wall 6. Therefore, the rivet head 38 does not protrude beyond the surface 39 of the inner side 31 or out of the surface 39. It is also shown that the rivet 38 is present in a manner abutting a surface 42 of the drawer rail 5 that is arranged opposite the side wall 6. Advantageously, the rivet 38 is present in a manner flush with the surface 42 or is proud therefrom to a comparatively small extent. As a result, a comparatively large range of movement of the extension mechanism 2 or of the bearing of the extension mechanism 2, for example of the bearing guide, is allowed.

The drawer rail 5 is U-shaped in cross section and wings 40, 41 of the drawer rail 5, which are present in a manner protruding from the side wall 6 in particular in a perpendicular direction in the arranged state, are configured for example in an undulating manner. This produces a guide for a bearing of the extension mechanism 2, in particular a ball bearing or a ball guide.

FIG. 4 also shows that the drawer rail 5 is fastened advantageously in a flush manner to the depression 24 or to the depression base 32 and thus in a flush manner to the side wall 6 or the frame 1 in the arranged state. FIG. 4 also shows a panel element 43 which is configured for example as a decoration and which is able to be arranged on the side wall 6 for example such that the panel element 43 advantageously conceals the depression 24-26. In particular, the panel element 43 covers the side wall 6 such that the panel element 43 forms the inner lateral surface of the drawer 8 in the arranged state.

Figure 5:
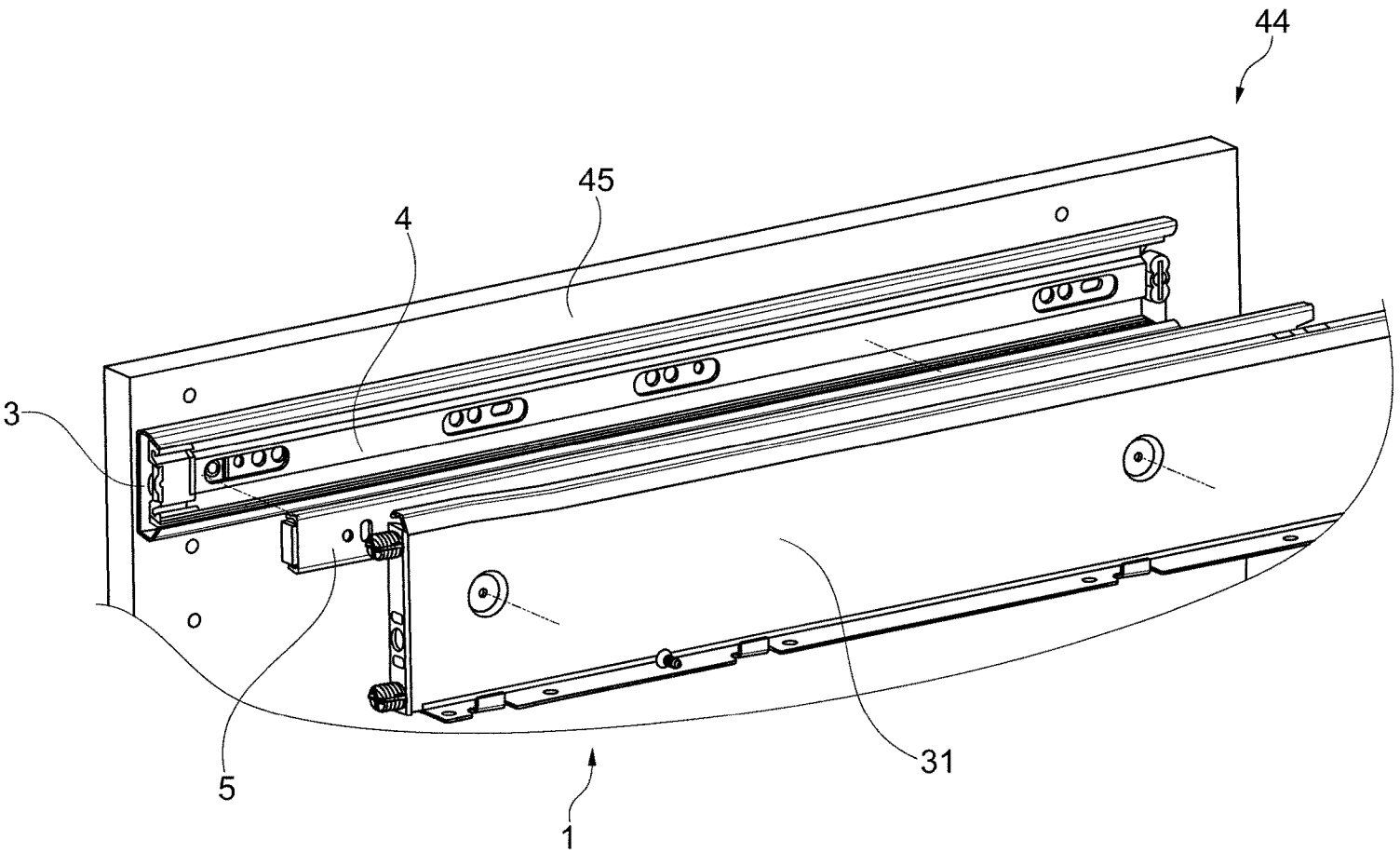
FIG. 5 shows an exploded illustration of an internal front lateral oblique perspective view of the frame from FIG. 1 having an arranged extension mechanism, wherein guide elements of the extension mechanism are arranged on a furniture side wall.
Figure 6:
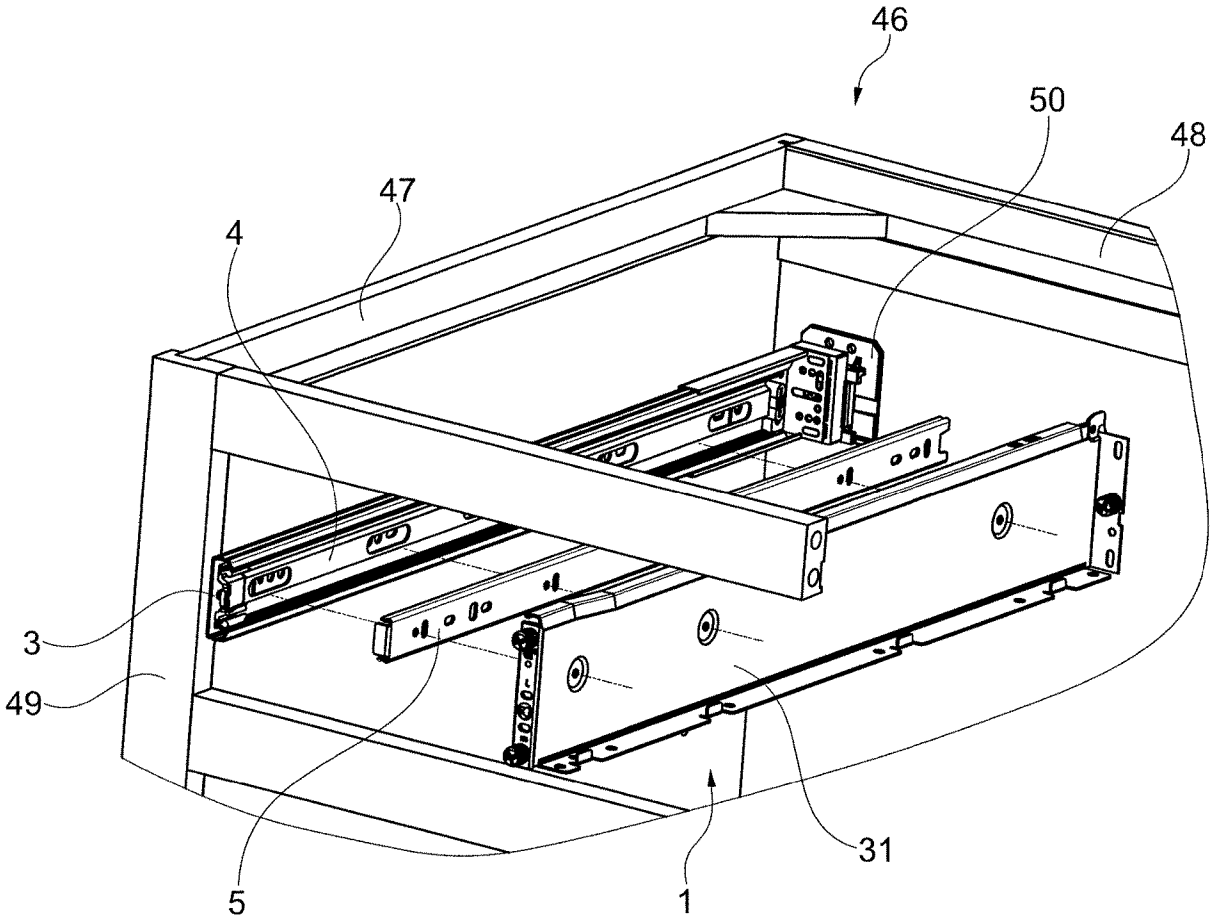
FIG. 6 shows an exploded illustration of an internal front lateral oblique perspective view of the frame from FIG. 1 having an arranged extension mechanism, wherein guide elements of the extension mechanism are arranged on a furniture rear wall and on a furniture front.

FIG. 5 shows an assembly variant of the extension mechanism 2 or of the frame 1 on an item of furniture 44. The extension mechanism 2 is configured for example such that it is able to be arranged on a furniture side wall 45. FIG. 6 shows a further assembly variant of the extension mechanism 2 or of the frame 1 on a further item of furniture 46 having a furniture side wall 47, a furniture rear wall 48 and a furniture front 49. The extension mechanism 2 is able to be arranged on the furniture front 49 at a first end and on the furniture rear wall 48 at the opposite second end, for example, with the aid of an assembly bracket 50, in what is known as a "face-frame" attachment. In this arrangement, the extension mechanism 2 is therefore not fastened to the furniture side wall 47.

Figure 7:
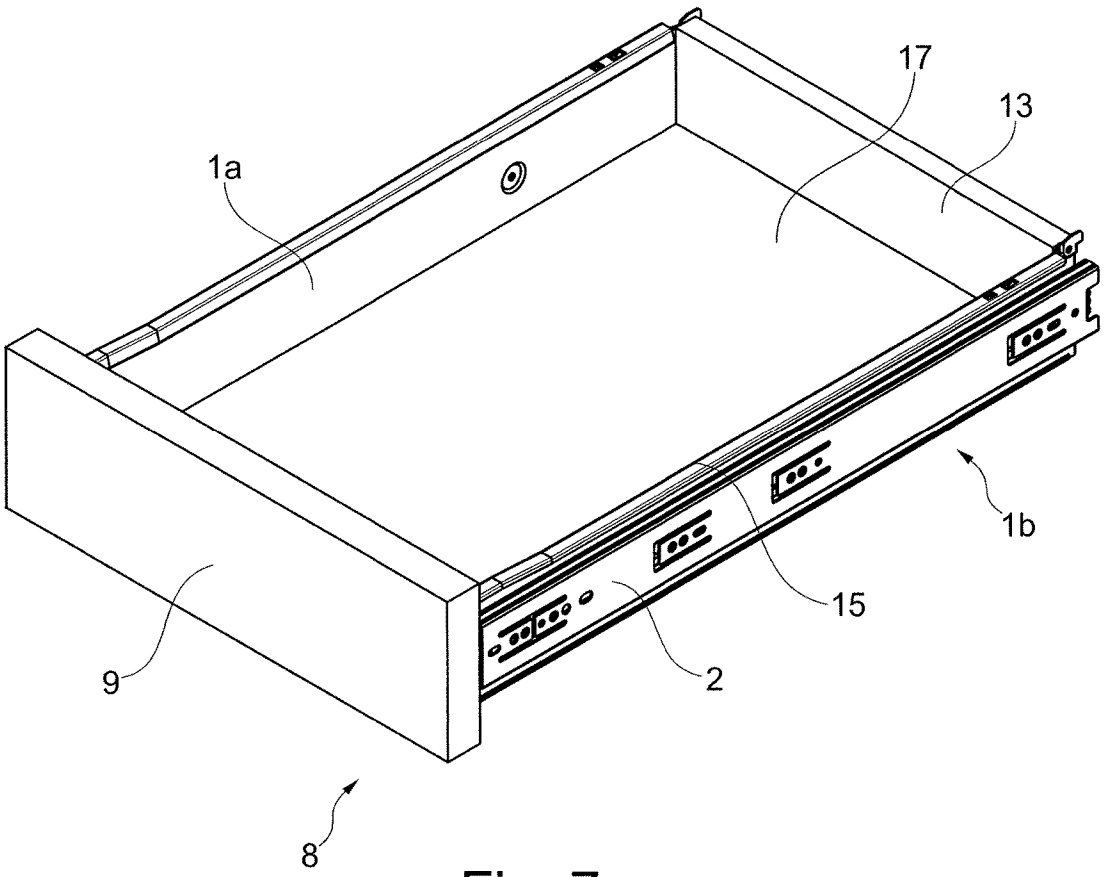
FIG. 7 shows a top front lateral oblique perspective view of the frame according to FIG. 1 in the state arranged on a drawer.
Figure 8:
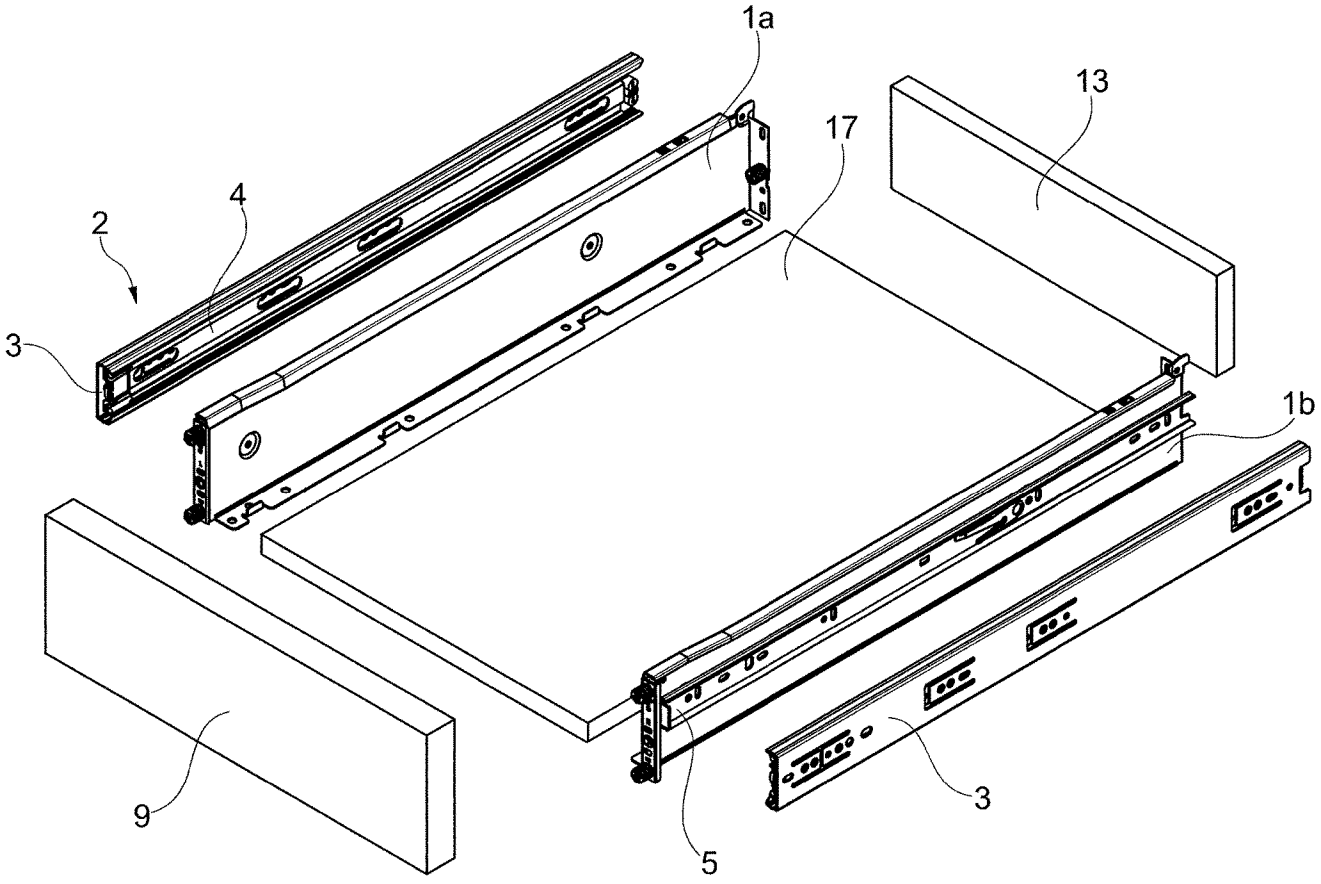
FIG. 8 shows an exploded illustration of a top front lateral oblique perspective view of the drawer from FIG. 7.

FIGS. 7 and 8 show the drawer 8 with two frames 1*a* and 1*b* configured in a mirror symmetrical manner with respect to one another, the frames 1*a* and 1*b* corresponding to the above-described frame 1 apart from the number of depressions formed. In each case two depressions are present on each of the frames 1*a* and 1*b*, rather than three as in the case of the frame 1.

FIGS. 9 and 10 furthermore illustrate a means of setting the drawer front 9 relative to the frame 1*b* in the form of a height adjustment and/or lateral adjustment means 53.

This enables height and lateral adjustment of the drawer front in the arranged state, with the result that a clearance between the drawer front and the rest of the item of furniture can be set.

LIST OF REFERENCE SIGNS 1, 1*a*, 1*b* Frame
2 Extension mechanism
3 Carcass rail
4 Central rail
5 Drawer rail
6 Side wall
7 Bent-over portion
8 Drawer
9 Drawer front
10 Peg
11 Peg
12 Bent-over portion
13 Drawer rear wall
14 Peg
15 Fold
16 Fold
17 Drawer base
18-20 Rivet
21-23 Assembly opening
24-26 Indentation
27 Outer side
28-30 Assembly opening
31 Inner side
32-34 Base element
35-37 Retaining element
38 Rivet head
39 Surface
40-41 Wing
42 Surface
43 Panel element
44, 46 Item of furniture
45, 47 Furniture side wall
48 Furniture rear wall
49 Furniture front
50 Assembly bracket
51 Screw
52 Cutout
53 Adjustment means

The invention claimed is:

1. A frame for a movable furniture part, wherein the frame comprises a single-walled frame element which forms a side wall of the movable furniture part, wherein a guide element of an extension mechanism for the movable furniture part is attached to an outer side of the single-walled frame element by fastening means, wherein the fastening means engage through the single-walled frame element, wherein the single-walled frame element has a depression, and the depression is formed in a recessed manner on an inner lateral surface of the single-walled frame element, wherein the depression is configured such that the depression protrudes from an outer surface of the outer side of the single-walled frame element, wherein the single-walled frame element comprises a bent-over rear flange portion configured to attach a rear wall of the movable furniture part and a bent-over front flange portion configured to attach a front wall of the movable furniture part thereon, wherein the depression is further configured such that the attached guide element is at a distance from a remaining outer surface of the single-walled frame element with respect to the depression, wherein the frame element forms an inner lateral surface of an interior of the movable furniture part, and wherein the single-walled frame element comprises at least one of an upper fold which forms an upper fold of the side wall of the movable furniture part and a lower fold which is configured to arrange a base of the movable furniture part.

2. The frame for a movable furniture part according to claim 1, wherein the extension mechanism comprises a ball guide.

3. The frame for a movable furniture part according to claim 1, wherein the fastening means comprises a rivet.

4. The frame for a movable furniture part according to claim 3, wherein the fastening means is arranged at the depression such that the fastening means does not protrude beyond a remaining inner lateral surface of the frame element.

5. The frame for a movable furniture part according to claim 1, wherein the guide element is arranged on the outer side of the single-walled frame element, in such a manner that the fastening means allows a movement of the guide element of the extension mechanism in an arranged state of the frame on the extension mechanism.

6. The frame for a movable furniture part according to claim 5, wherein the guide element arranged on the outer side of the single-walled frame element is U-shaped.

7. The frame for a movable furniture part according to claim 3, wherein the depression and/or the fastening means are covered by a covering means.

8. The frame for a movable furniture part according to claim 3, wherein the depression has a base that is recessed with respect to the inner lateral surface of the single-walled frame element, the guide element being fastened to said base of the depression.

9. The frame for a movable furniture part according to claim 1, wherein the single-walled frame element, is a single piece component.

10. The frame for a movable furniture part according to claim 1, wherein the single-walled frame element and/or the guide element, is formed from a metal and/or a plastics material.

11. The frame for a movable furniture part according to claim 1, wherein in order to connect the bent-over front flange portion to the front wall of the movable furniture part and the bent-over rear flange portion to the rear wall of the movable furniture part, a plug and/or a screw is provided.

12. The frame for a movable furniture part according to claim 1, wherein the frame has a height adjustment and/or lateral adjustment means on the bent-over front and/or rear flange portion, in order to be able to position the front wall and/or the rear wall of the movable furniture part at a height and/or in a lateral orientation with respect to the frame.

13. A movable furniture part having a frame according to claim 1.

14. An item of furniture having a frame according to claim 1.

15. A frame for a movable furniture part, in particular for a drawer, wherein the frame comprises a single-walled frame element which forms a side wall of the movable furniture part, wherein a guide element of an extension mechanism for the movable furniture part is attached to an outer side of the single-walled frame element by fastening means, wherein the guide element is joined to the single-walled frame element in a fixed position on the single-walled frame element, which forms the side wall of the movable furniture part, the guide element being at least one of riveted, clinched, welded, and bonded to the single-walled frame element, wherein the single-walled frame element comprises a bent-over rear flange portion configured to attach a rear wall of the movable furniture part and a bent-over front flange portion configured to attach a front wall of the movable furniture part thereon, wherein the single-walled frame element forms an inner lateral surface of an interior of the movable furniture part, wherein the single-walled frame element has a depression, wherein the depression is configured such that the attached guide element is at a distance from a remaining outer surface of the single-walled frame element with respect to the depression, and wherein the single-walled frame element comprises at least one of an upper fold which forms an upper lateral surface of the side wall of the movable furniture part and a lower fold which is configured to arrange a base of the movable furniture part.

* * * * *